US007306713B2

(12) United States Patent
Siskin et al.

(10) Patent No.: US 7,306,713 B2
(45) Date of Patent: Dec. 11, 2007

(54) DELAYED COKING PROCESS FOR PRODUCING FREE-FLOWING COKE USING A SUBSTANTIALLY METALS-FREE ADDITIVE

(75) Inventors: Michael Siskin, Randolph, NJ (US); Martin L. Gorbaty, Westfield, NJ (US); Christopher P. Eppig, Vienna, VA (US); David T. Ferrughelli, Flemington, NJ (US); Simon R. Kelemen, Annandale, NJ (US); Leo D. Brown, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 251 days.

(21) Appl. No.: 10/846,033

(22) Filed: May 14, 2004

(65) Prior Publication Data

US 2004/0256292 A1 Dec. 23, 2004

Related U.S. Application Data

(60) Provisional application No. 60/471,324, filed on May 16, 2003.

(51) Int. Cl.
*C10G 9/14* (2006.01)

(52) U.S. Cl. ..... 208/131

(58) Field of Classification Search ..... 208/131
See application file for complete search history.

(56) References Cited

U.S. PATENT DOCUMENTS

| | | | | |
|---|---|---|---|---|
| 3,558,474 | A | 1/1971 | Gleim et al. | 208/108 |
| 3,617,514 | A | 11/1971 | Marlar | 208/131 |
| 3,684,697 | A | 8/1972 | Gamson | 208/131 |
| 3,707,459 | A | 12/1972 | Mason et al. | 208/76 |
| 3,769,200 | A | 10/1973 | Folkins | 208/53 |
| 3,852,047 | A | 12/1974 | Schlinger et al. | 44/24 |
| 4,140,623 | A | 2/1979 | Sooter et al. | 208/131 |
| 4,298,455 | A | 11/1981 | Huang | 208/48 AA |
| 4,399,024 | A | 8/1983 | Fukui et al. | 208/131 |
| 4,411,770 | A | 10/1983 | Chen et al. | 208/111 |
| 4,430,197 | A | 2/1984 | Poynor et al. | 208/56 |
| 4,440,625 | A | 4/1984 | Go et al. | 208/48 AA |
| 4,455,219 | A | 6/1984 | Janssen et al. | 208/131 |
| 4,518,487 | A | 5/1985 | Graf et al. | 208/131 |
| 4,529,501 | A | 7/1985 | George | 208/127 |
| 4,549,934 | A | 10/1985 | Graf et al. | 196/98 |
| 4,592,830 | A | 6/1986 | Howell et al. | 208/94 |
| 4,612,109 | A | 9/1986 | Dillon et al. | 208/131 |
| 4,616,308 | A | 10/1986 | Morshedi et al. | 364/159 |
| 4,659,453 | A | 4/1987 | Kukes et al. | 208/108 |
| 4,927,561 | A | 5/1990 | Forester | 252/389.22 |
| 5,160,602 | A | 11/1992 | Becraft et al. | 208/131 |
| 5,248,410 | A | 9/1993 | Clausen et al. | 208/131 |
| 5,258,115 | A | 11/1993 | Heck et al. | 208/131 |
| 5,460,714 | A | 10/1995 | Fixari et al. | 208/112 |
| 5,645,711 | A | 7/1997 | Hraban et al. | 208/131 |
| 5,820,750 | A | 10/1998 | Blum et al. | 208/263 |
| 5,853,565 | A | 12/1998 | Cayton | 208/48 AA |
| 6,048,904 | A | 4/2000 | Wiehe et al. | 516/20 |
| 6,168,709 | B1 | 1/2001 | Etter | 208/131 |
| 6,193,875 | B1 | 2/2001 | Pereira et al. | 208/130 |
| 6,264,829 | B1 | 7/2001 | Antalffy et al. | 208/131 |
| 6,387,840 | B1 | 5/2002 | Salazar et al. | 502/170 |
| 6,611,735 | B1 | 8/2003 | Henly et al. | 700/266 |
| 6,660,131 | B2 | 12/2003 | Lah | 202/245 |
| 2002/0033265 | A1 | 3/2002 | Varadaraj | 166/303 |
| 2002/0125174 | A1 | 9/2002 | Varadaraj | 208/263 |
| 2002/0161059 | A1 | 10/2002 | Varadaraj et al. | 516/113 |
| 2003/0127314 | A1 | 7/2003 | Bell et al. | 202/262 |
| 2003/0132139 | A1 | 7/2003 | Varadaraj | 208/265 |
| 2003/0199194 | A1 | 10/2003 | Varadaraj | 516/52 |
| 2004/0035749 | A1 | 2/2004 | Khan et al. | 208/106 |

FOREIGN PATENT DOCUMENTS

| | | |
|---|---|---|
| EP | 0031697 | 8/1981 |
| EP | 175511 | 6/1988 |
| GB | 1218117 | 6/1971 |
| WO | 95/14069 | 5/1995 |
| WO | 99/64540 | 12/1999 |
| WO | 03042330 | 5/2003 |
| WO | 03048271 | 6/2003 |
| WO | 2004/104139 | 2/2004 |
| WO | 2004/038316 | 6/2004 |

OTHER PUBLICATIONS

"Applied artificial intelligence for delayed coking," J. J. Kelley, Foster Wheeler USA Corp., Houston, TX, reprinted from Hydrocarbon Processing magazine, Nov. 2000 issue, pp. 144-A to 144-J.

"Tutorial: Delayed Coking Fundamentals," Ellis, Paul J., Paul, Christopher A. Great Lakes Carbon Corporation, Port Arthur, TX. copyright 1998 (unpublished). Presented at the AIChE 1998 Spring National Meeting, New Orleans, LA, Mar. 8-12, 1998.

(Continued)

*Primary Examiner*—Glenn Caldarola
*Assistant Examiner*—John Douglas
(74) *Attorney, Agent, or Firm*—Gerald J. Hughes; W. Robinson H. Clark

(57) ABSTRACT

A delayed coking process for making substantially free-flowing shot coke. A coker feedstock, such as a vacuum residuum, is treated with an additive, such as a elemental sulfur, high surface area substantially metals-free solids, process fines, a mineral acid anhydride and the like. The treated feedstock is then heated to coking temperatures and passed to a coker drum for a time sufficient to allow volatiles to evolve and to produce a substantially free-flowing shot coke.

14 Claims, 4 Drawing Sheets

OTHER PUBLICATIONS

"The effect of carbon additives on the mesophase induction period of Athabasca bitumen," Gentzis, Thomas; Rahimi, Parviz; Malhotra, Ripudaman; Hirschon, Albert S. Fuel Processing Technology 69 (2001) 191-203.

"Upgrading of petroleum residue with dispersed additives," Dabkowski, M.J.; Shih, S.S.; Albinson, K.R., Mobil Research & Development Corporation, Paulsboro, NJ. Presented as Paper 19E, at the 1990 AIChE National Meeting.

Giavarini, C.; Mastrofini, D.; Scrsella, M., "Macrostructure and Rheological Properties of Chemically Modified Residues and Bitumens," Energy & Fuels 2000, 14, pp. 495-502.

Lakatos-Szabo, J.; Lakatos, I., "Effect of sodium hydroxide on interfacial rheological properties of oil-water systems," Research Institute of Applied chemistry, University of Miskolc, Hungary, accepted Aug. 24, 1998, Elsevier Science B. V., Physicochemical and Engineering Aspects 149 (1999), pp. 507-513.

DELAYED COKING PROCESS FOR PRODUCING FREE-FLOWING COKE USING A SUBSTANTIALLY METALS-FREE ADDITIVE

CROSS-REFERENCE TO RELATED APPLICATION

This application claims benefit of U.S. Provisional Patent Application Ser. No. 60/471,324 filed May 16, 2003.

FIELD OF THE INVENTION

The present invention relates to a delayed coking process for making substantially free-flowing shot coke. A coker feedstock, such as a vacuum residuum, is treated with an additive, such as a elemental sulfur, high surface area substantially metals-free solids, process fines, a mineral acid anhydride and the like. The treated feedstock is then heated to coking temperatures and passed to a coker drum for a time sufficient to allow volatiles to evolve and to produce a substantially free-flowing shot coke.

DESCRIPTION OF RELATED ART

Delayed coking involves thermal decomposition of petroleum residua (resids) to produce gas, liquid streams of various boiling ranges, and coke. Delayed coking of resids from heavy and heavy sour (high sulfur) crude oils is carried out primarily as a means of disposing of these low value feedstocks by converting part of the resids to more valuable liquid and gaseous products. Although the resulting coke is generally thought of as a low value by-product, it may have some value, depending on its grade, as a fuel (fuel grade coke), electrodes for aluminum manufacture (anode grade coke), etc.

In the delayed coking process, the feedstock is rapidly heated in a fired heater or tubular furnace. The heated feedstock is then passed to a coking drum that is maintained at conditions under which coking occurs, generally at temperatures above about 400° C. under super-atmospheric pressures. The heated residuum feed in the coker drum also forms volatile components that are removed overhead and passed to a fractionator, leaving coke behind. When the coker drum is full of coke, the heated feed is switched to another drum and hydrocarbon vapors are purged from the coke drum with steam. The drum is then quenched with water to lower the temperature to less than about 100° C. after which the water is drained. When the cooling and draining steps are complete, the drum is opened and the coke is removed after drilling and/or cutting using high velocity water jets.

For example, a hole is typically bored through the center of the coke bed using water jet nozzles located on a boring tool. Nozzles oriented horizontally on the head of a cutting tool cut the coke from the drum. The coke removal process adds considerably to the throughput time of the process. Thus, it would be desirable to produce a free-flowing coke in the coker drum that would not require the expense and time associated with conventional coke removal.

Even though the coker drum may appear to be completely cooled, areas of the drum do not completely cool. This phenomenon, sometimes referred to as "hot drum", may be the result of a combination of morphologies of coke being present in the drum, which may contain a combination of more than one type of solid coke product, i.e., needle coke, sponge coke and shot coke. Since unagglomerated shot coke may cool faster than other coke morphologies, such as large shot coke masses or sponge coke, it would be desirable to produce predominantly substantially free flowing shot coke in a delayed coker, in order to avoid or minimize hot drums.

SUMMARY OF THE INVENTION

In an embodiment, there is provided a delayed coking process comprising:

a) heating a petroleum resid, in a first heating zone, to a temperature below coking temperatures but to a temperature wherein the resid becomes a pumpable liquid;
b) conducting said heated petroleum resid to a second heating zone wherein it is heated to an effective coking temperatures;
c) conducting said resid from said second heating zone to a coking zone wherein vapor products are collected overhead and a coke product is formed;
d) introducing into said residuum hydrocarbon fraction at least one metals-free additive that is effective for the formation of substantially free-flowing coke, wherein said metals free additive is introduced into said vacuum resid at a point upstream of the second heating zone, upstream of the coking heating zone, or both.

In a preferred embodiment, the coking zone is in a delayed coker drum, and a substantially free-flowing shot coke product is removed from the coker drum.

In a preferred embodiment, the coking zone is in a delayed coker drum, and a substantially free-flowing shot coke product is removed from the coker drum.

In another embodiment, there is provided a delayed coking process comprising:

a) contacting a vacuum resid with an effective amount of at least one metals-free additive at a temperature from about 70° C. to about 370° C. for a dispersing time sufficient to disperse the additive substantially uniformly into the feed, which additive is one that favors the formation of shot coke;
b) heating the treated resid to a temperature effective for coking said feed;
c) charging said heated treated resid to a coking zone at a pressure from about 15 to 80 psig for a coking time to form a bed of hot coke; and
d) quenching at least a portion of the bed of hot coke with water.

In another embodiment a substantially free-flowing shot coke product is formed and removed from the coking zone. The coking zone is preferably a delayed coker drum. The additive can be incorporated and combined with the feed either before the feed is introduced into the heating zone, which is a coker furnace, or it can be introduced into the feed between the coker furnace and coker drum. It is also within the scope of this invention that the additive be introduced into the feed in both locations. The same additive, or additives, can be added independently at each location or a different additive or additives can be added at each location.

Use of the term "combine" and "contact" are meant in their broad sense, i.e., that in some cases physical and/or chemical changes in the additive and/or the feed can occur in the additive, the feed, or both when additive is present in the feed. In other words, the invention is not restricted to cases where the additive and/or feed undergo no chemical and/or physical change following or in the course of the contacting and/or combining. An "effective amount" of additive is the amount of additive(s) that when contacted with the feed would result in the formation of shot coke in the coking zones, preferably substantially free-flowing shot coke. An effective amount typically ranges from about 100 to about 100,000 ppm (based on the total weight of the additive and feed), but would depend on the species of additive and its chemical and physical form. While not wishing to be bound by any theory or model, it is believed that the effective amount is less for additives species in a physical and chemical form that lead to better dispersion in the feed than for additive species that are more difficult to disperse. This is why additives that are at least partially soluble in organics, more preferably in the resid feed, are most preferred.

Preferably, a caustic species is added to the resid coker feedstock. When used, the caustic species may be added before, during, or after heating in the coker furnace. Addition of caustic will reduce the Total Acid Number (TAN) of the resid coker feedstock and also convert naphthenic acids to metal, e.g., sodium, naphthenates.

Uniform dispersal of the additive into the resid feed is desirable to avoid heterogeneous areas of shot coke formation. That is, one does not want locations in the coke drum where the coke is substantially free flowing and other areas where the coke is substantially non-free flowing. Dispersing of the additive is accomplished by any number of ways, for example, by solubilization of the additive into the resid feed, or by reducing the viscosity of the resid prior to mixing in the additive, e.g., by heating, solvent addition, etc. High energy mixing or use of static mixing devices may be employed to assist in dispersal of the additive agent.

Preferably, all or substantially all of the coke formed in the process is shot coke, more preferably, substantially free-flowing shot coke. It is also preferred that at least a portion of volatile species present in the coker drum during and after coking be separated and conducted away from the process, preferably overhead of the coker drum.

BRIEF DESCRIPTION OF THE FIGURES

FIGS. 1-4 used cross-polarized light, with a viewing area of 170 by 136 micrometers.

DETAILED DESCRIPTION OF THE INVENTION

Figure 1:
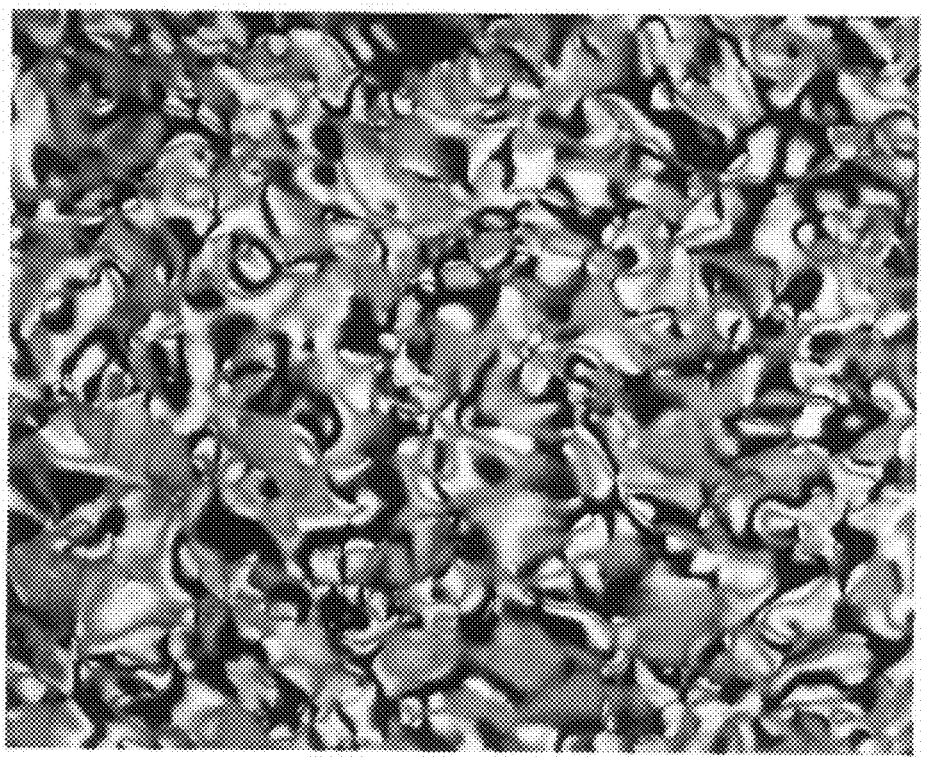
FIG. 1 is an optical micrograph showing coke formed from a sponge coke making resid feed (Mid West Rocky Mountain) that contained no additive. The figure shows flow domains ranging in size from about 10 to about 35 micrometers (typical of sponge coke), and a coarse mosaic ranging from about 5 to about 10 micrometers (typical of shot coke).

Petroleum vacuum residua ("resid") feedstocks are suitable for delayed coking. Such petroleum residua are frequently obtained after removal of distillates from crude feedstocks under vacuum and are characterized as being comprised of components of large molecular size and weight, generally containing: (a) asphaltenes and other high molecular weight aromatic structures that would inhibit the rate of hydrotreating/hydrocracking and cause catalyst deactivation; (b) metal contaminants occurring naturally in the crude or resulting from prior treatment of the crude, which contaminants would tend to deactivate hydrotreating/hydrocracking catalysts and interfere with catalyst regeneration; and (c) a relatively high content of sulfur and nitrogen compounds that give rise to objectionable quantities of $SO_2$, $SO_3$, and $NO_x$ upon combustion of the petroleum residuum. Nitrogen compounds present in the resid also have a tendency to deactivate catalytic cracking catalysts.

In an embodiment, resid feedstocks include but are not limited to residues from the atmospheric and vacuum distillation of petroleum crudes or the atmospheric or vacuum distillation of heavy oils, visbroken resids, tars from deasphalting units or combinations of these materials. Atmospheric and vacuum topped heavy bitumens can also be employed. Typically, such feedstocks are high-boiling hydrocarbonaceous materials having a nominal initial boiling point of about 538° C. or higher, an API gravity of about 20° or less, and a Conradson Carbon Residue content of about 0 to 40 weight percent.

In an embodiment, the resid feed is subjected to delayed coking. Generally, in a delayed coking process, a residue fraction, such as a petroleum residuum chargestock is pumped to a heater at a pressure of about 50 to 550 psig, where it is heated to a temperature from about 480° C. to about 520° C. It is then discharged into a coking zone, typically a vertically-oriented, insulated coker drum through an inlet at the base of the drum. Pressure in the drum is usually relatively low, such as about 15 to 80 psig to allow volatiles to be removed overhead. Typical operating temperatures of the drum will be between about 410° C. and 475° C. The hot feedstock thermally cracks over a period of time (the "coking time") in the coker drum, liberating volatiles composed primarily of hydrocarbon products, that continuously rise through the coke mass and are collected overhead. The volatile products are sent to a coker fractionator for distillation and recovery of coker gases, gasoline, light gas oil, and heavy gas oil. In an embodiment, a portion of the heavy coker gas oil present in the product stream introduced into the coker fractionator can be captured for recycle and combined with the fresh feed (coker feed component), thereby forming the coker heater or coker furnace charge. In addition to the volatile products, delayed coking also forms solid product.

There are generally three different types of solid delayed coker products that have different values, appearances and properties, i.e., needle coke, sponge coke, and shot coke.

Needle coke is the highest quality of the three varieties. Needle coke, upon further thermal treatment, has high electrical conductivity (and a low coefficient of thermal expansion) and is used in electric arc steel production. It is relatively low in sulfur and metals and is frequently produced from some of the higher quality coker feedstocks that include more aromatic feedstocks such as slurry and decant oils from catalytic crackers and thermal cracking tars. Typically, it is not formed by delayed coking of resid feeds.

Sponge coke, a lower quality coke, is most often formed in refineries. Low quality refinery coker feedstocks having significant amounts of asphaltenes, heteroatoms and metals produce this lower quality coke. If the sulfur and metals content is low enough, sponge coke can be used for the manufacture of electrodes for the aluminum industry. If the sulfur and metals content is too high, then the coke can be used as fuel. The name "sponge coke" comes from its porous, sponge-like appearance. Conventional delayed coking processes, using the preferred vacuum resid feedstock of the present invention, will typically produce sponge coke, which is produced as an agglomerated mass that needs an extensive removal process including drilling and water-jet technology. As discussed, this considerably complicates the process by increasing cycle time.

Shot coke has been considered the lowest quality coke. The term "shot coke" comes from its shape which is similar to that of BB sized (about 1/16 inch to 3/8 inch) balls. Shot coke, like the other types of coke, has a tendency to agglomerate, especially in admixture with sponge coke, into larger masses, sometimes larger than a foot in diameter. This can cause refinery equipment and processing problems. Shot coke is usually made from the lowest quality high resin-asphaltene feeds and makes a good high sulfur fuel source, particularly for use in cement kilns and steel manufacture.

It has been discovered that substantially free-flowing shot coke can be produced by treating the residuum feedstock with one or more metal additives of the present invention. The additives are those that enhance the production of shot coke during delayed coking. A resid feed is subjected to treatment with one or more of such additives, at effective temperatures, i.e., at temperatures that will encourage the additives' dispersal in the feed stock. Such temperatures will typically be from about 70° C. to about 500° C., preferably from about 150° C. to about 370° C., more preferably from about 185° C. to about 350° C. The additive can be in any suitable form including gas, liquid or solid. Non-limiting examples of substantially metals-free additives that can be used in the practice of the present invention include elemental sulfur, high surface area substantially metals-free solids, such as rice hulls, sugars, cellulose, ground coals, ground auto tires; inorganic oxides such as fumed silica; salts of oxides, such as ammonium silicate and mineral acids such as sulfuric acid, phosphoric acid, and acid anhydrides.

It is to be understood that before or after the resid is treated with the additive, a caustic species, preferably in aqueous form, may optionally be added. The caustic can be added before, during, or after the resid is passed to the coker furnace and heated to coking temperatures. Spent caustic obtained from hydrocarbon processing can be used. Such spent caustic can contain dissolved hydrocarbons, and salts of organic acids, e.g., carboxylic acids, phenols, naphthenic acids and the like.

Figure 2:
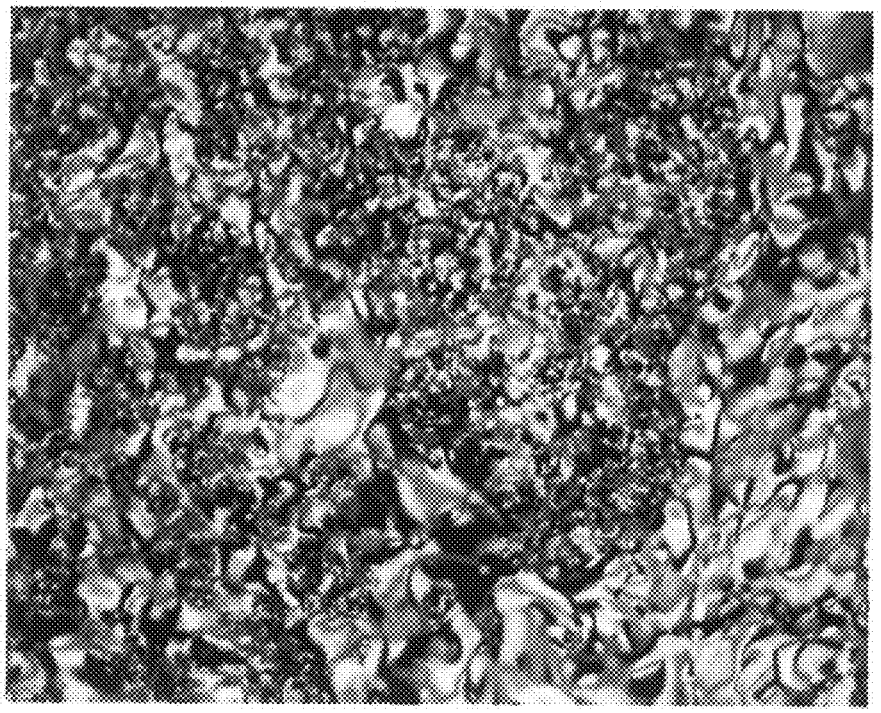
FIG. 2 shows the effect fumed silica on coke morphology. The figure is an optical micrograph showing coke formed from a resid feed to which 2500 ppm of fumed silica was added. The figure shows some coke domains of about 5-30 micrometers, but with abundant localized clusters of 1-5 micrometers. The implication is that the additive was not homogeneously dispersed in the vacuum resid and that if it was, or if a transition coke-forming vacuum resid was used, that free flowing shot coke would be formed. A transition coke-forming vacuum resid produces a mixture of coke morphologies, e.g., sponge coke and shot coke wherein the sponge coke can be bonded to the shot coke.
Figure 3:
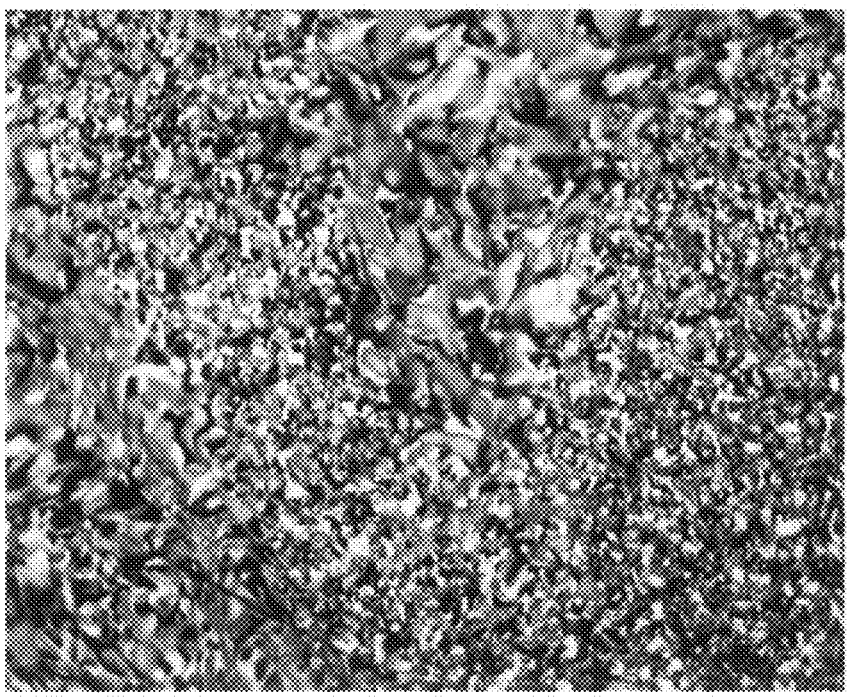
FIG. 3 shows the effect of elemental sulfur on coke morphology. The figure is an optical micrograph showing coke formed from a resid feed to which 20,000 ppm (2 wt. %) elemental sulfur was added. The figure shows some coke with a medium/coarse mosaic of about 3 to about 12 micrometers. Some coke in localized regions have a mosaic in the range of about 1 to about 3 micrometers. A mosaic in the range of <1 to about 10 micrometers is typical of shot coke.
Figure 4:
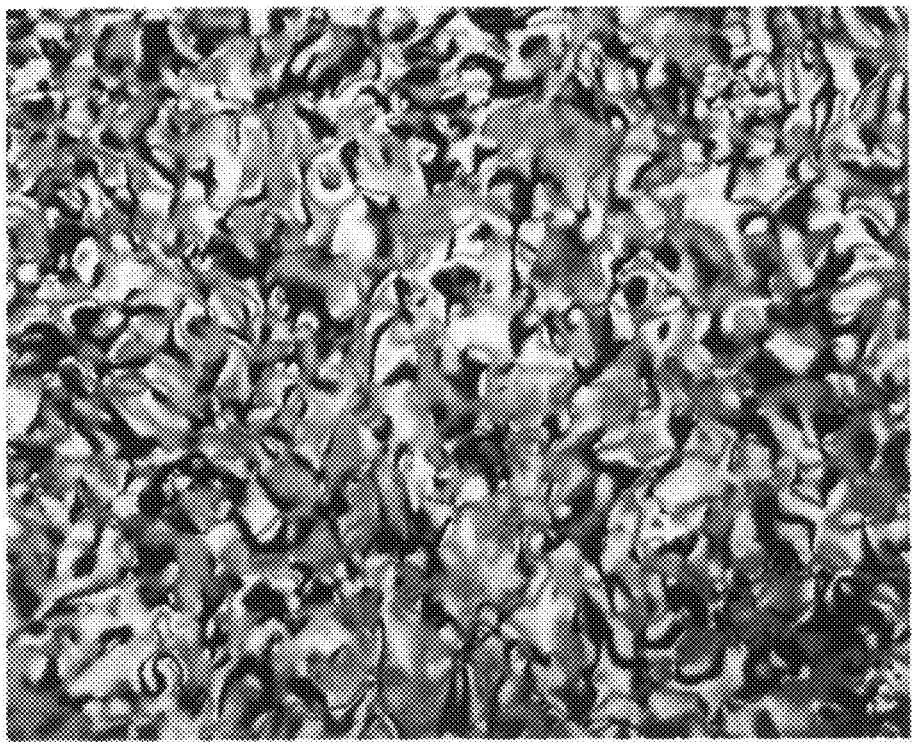
FIG. 4 also shows the effect of elemental sulfur on coke morphology. The figure is an optical micrograph showing coke formed from a resid feed to which 5,000 ppm (0.5 wt. %) elemental sulfur was added. The figure shows some coke with a medium/coarse mosaic of about 3 to about 12 micrometers. Some coke in localized regions have a mosaic in the range of about 1 to about 3 micrometers. A mosaic in the range of <1 to about 10 micrometers is typical of shot coke.

The precise conditions at which the resid feedstock is treated with the additive is feed and additive dependent. That is, the conditions at which the feed is treated with the additive is dependent on the composition and properties of the feed to be coked and the additive. These conditions can be determined conventionally. For example, several runs would be made with a particular feed containing an additive at different times and temperatures followed by coking in a bench-scale reactor such as a Microcarbon Residue Test Unit (MCRTU). The resulting coke is then analyzed by use of an optical and/or polarized light microscopy as set forth herein. The preferred coke morphology (i.e., one that will produce substantially free-flowing coke) is a coke microstructure of discrete micro-domains having an average size of about 0.5 to 10 μm, preferably from about 1 to 5 μm, somewhat like the mosaic shown in FIGS. 2 and 3 hereof. Coke microstructure that represents coke that is not free-flowing shot coke is shown in FIG. 1 hereof, showing a coke microstructure that is composed substantially of non-discrete, or substantially large flow domains up to about 60 μm or greater in size, typically from about 10 to 60 μm.

Conventional coke processing aids, including an anti-foaming agent, can be employed in the process of the present invention wherein a resid feedstock is air blown to a target softening point as described in U.S. Pat. No. 3,960,704. While shot coke has been produced by conventional methods, it is typically agglomerated to such a degree that water-jet technology is still needed for its removal. Additives are employed to provide for the formation of the desired, substantially free-flowing shot coke.

In one embodiment of the present invention, the resid feedstock is first treated with a substantially metals-free additive that encourages the formation of substantially free-flowing shot coke. By keeping the coker drum at relatively low pressures, much of the evolving volatiles can be collected overhead, which prevents undesirable agglomeration of the resulting shot coke. The combined feed ratio ("CFR") is the volumetric ratio of furnace charge (fresh feed plus recycle oil) to fresh feed to the continuous delayed coker operation. Delayed coking operations typically employ recycles of about 5 vol. % to 25% (CFRs of about 1.05 to 1.25). In some instances there is 0 recycle and sometimes in special applications recycle up to 200%. CFRs should be low to aid in free flowing shot coke formation, and preferably no recycle should be used.

While not wishing to be bound to any specific theory or model, the additive or mixture of additives employed are believed to function via one or more of the following pathways: as dehydrogenation and cross-linking agents, as agents that convert metals present in the feed into metal sulfides that are catalysts for dehydrogenation and shot coke formation, agents that add species into the feed that influence or direct the formation of shot coke or are converted to species, e.g., metal sulfides, that are catalysts for shot coke formation, as particles that influence the formation of shot coke by acting as microscopic seed particles for the shot coke to be formed around, as Lewis acid cross-linking catalysts, and the like. Additives may also alter or build viscosity of the plastic mass of reacting components so that shear forces in the coker furnace, transfer line and coke drum roll the plastic mass into small spheres. Even though different additives and mixtures of additives may be employed, similar methods are used for contacting the additive(s) with the feed.

Typically, the additive(s) used herein are conducted to the coking process in a continuous mode. If needed, the additive could be dissolved or slurried into an appropriate transfer fluid in a batch mixing vessel arrangement. The fluid mixture or slurry is then pumped into the coking process at a rate to achieve the desired concentration of additives in the feed. The introduction point of the additive can be, for example, at the discharge of the furnace feed charge pumps, or near the exit of the coker transfer line. There can be a pair of mixing vessels operated in a fashion such that there is continuous introduction of the additives into the coking process.

The rate of additive introduction can be adjusted according to the nature of the resid feed to the coker. As discussed, feeds which are on the threshold of producing shot coke may require less additive than those which are farther away from the threshold.

For additives that are difficult to dissolve or disperse in resid feeds, the additive(s) are transferred into the mixing/slurry vessel and mixed with a slurry medium that is compatible with the feed. Non-limiting examples of suitable slurry mediums include coker heavy gas oil, water, etc. Energy may be provided into the vessel, e.g., through a mixer for dispersing the additive.

For additives which can be more readily dissolved or dispersed in resid feeds, the additive(s) are transferred into the mixing vessel and mixed with a fluid transfer medium that is compatible with the feed. Non-limiting examples of suitable fluid transfer mediums include warm resid (temp. between about 150° C. to about 300° C.), coker heavy gas oil, light cycle oil, heavy reformate, and mixtures thereof. Cat slurry oil (CSO) may also be used also, though under some conditions it may inhibit the additives' ability to produce loose shot coke. Energy may provided into the vessel, e.g., through a mixer, for dispersing the additive into the fluid transfer medium.

The present invention will be better understood by reference to the following non-limiting examples that are presented for illustrative purposes.

EXAMPLES

General Procedures for Addition of Additives into Vacuum Resid Feeds

The resid feed is heated to about 70-150° C. to decrease its viscosity. The additive (in weight parts per million, wppm) is then added slowly with mixing for a time sufficient to disperse and/or solubilize the additive(s) (a "dispersing time"). For laboratory experiments, it is generally preferred to first dissolve and/or disperse the additive in a solvent, e.g., toluene, tetrahydrofuran, or water and blend it with stirring into the heated resid, or into the resid to which some solvent has been added to reduce its viscosity. Solvent can then be removed. In a refinery, the additive contacts the resid when it is added to or combined with the resid feed. As discussed, the contacting of the additive and the feed can be accomplished by blending a feed fraction containing additive species (including feed fractions that naturally contain such species) into the feed. To assure maximum dispersion of the additive into the vacuum resid feed, the reaction mixture can be heat soaked.

The following tests were conducted using elemental sulfur, and fumed silica. Additive concentration, heat soak time, and the resulting coke morphology as determined from optical micrographs are set forth in Table 1. A control sample of resid with no additive is set forth in the first row of Table 1, by way of comparison.

TABLE 1

Effect of Additives on a Sponge Coke - Forming Vacuum Resid

| Additive | Concentration (wppm) | Heat Soak at 370° C. (min) | MCR Domain/ Mosaic-Domain Size/Comments (μm) |
|---|---|---|---|
| None | 0 | 30 | 5-30-Sponge coke |
| Sulfur | 10,000 | 100 | 3-12 with occasional regions of 1-3 μm. Illustrates ability to form shot coke and the effect of heterogeneous dispersion of additive. |
| Sulfur | 20,000 | 30 | Medium/coarse mosaic (3-12 μm) and abundant localized clusters 1-3 μm. |
| $H_3PO_4$ | 2,500 | 30 | 5-25 with some regions of 1-4 μm. |
| $P_2O_5$ | 2,500 | 30 | Small domains (10-15 μm) and medium/coarse domains (3-10 μm) |
| Fumed Silica | 2,500 | 30 | Illustrates effect of heterogeneous dispersion of additive. |

Polarizing light microscopy was used in these examples for comparing and contrasting structures of green coke (i.e., non-calcined coke) samples.

At the macroscopic scale, i.e., at a scale that is readily evident to the naked eye, petroleum sponge and shot green cokes are quite different—sponge has a porous sponge-like appearance, and shot coke has a spherical cluster appearance. However, under magnification with an optical microscope, or polarized-light optical microscope, additional differences between different green coke samples may be seen, and these are dependent upon amount of magnification.

For example, utilizing a polarized light microscope, at a low resolution where 10 micrometer features are discernable, sponge coke appears highly anisotropic, the center of a typical shot coke sphere appears much less anisotropic, and the surface of a shot coke sphere appears fairly anisotropic.

At higher resolutions, e.g., where 0.5 micrometer features are discernable (this is near the limit of resolution of optical microscopy), a green sponge coke sample still appears highly anisotropic. The center of a shot coke sphere at this resolution is now revealed to have some anisotropy, but the anisotropy is much less than that seen in the sponge coke sample.

It should be noted that the optical anisotropy discussed herein is not the same as "thermal anisotropy", a term known to those skilled in the art of coking. Thermal anisotropy refers to coke bulk thermal properties such as coefficient of thermal expansion, which is typically measured on cokes which have been calcined, and fabricated into electrodes.

Microcarbon residue (MCR) tests were performed on the above feeds to generate cokes to be evaluated by optical microscopy. MCR techniques are described in J. B. Green, et al., *Energy Fuels*, 1992, 6, 836-844. The following is the procedure used for the MCR tests:

| Heating Profile | Time (min) | $N_2$ Flow (cc/min) |
|---|---|---|
| Heat from room temp to 100° C. | 10 | 66 |
| Heat from 100° C. to 300° C. then to 500° C. | 30 | 66/19.5 |
| Hold at 500° C. | 15 | 19.5 |
| Cool to room temp | 40 | 19.5 |

FIG. 1 is a cross-polarized light photomicrograph showing the microstructure of the resulting coke from an untreated resid feed. The viewing area for both is 170 microns by 136 microns. The untreated residuum resulted in a coke with a microstructure that was not discrete fine domains. The domains were relatively large (10-35 μm) flow domains. This indicates that sponge coke will be produced in the coker drum of a delayed coker. The microstructure of FIG. 2, in which the vacuum residuum sample was treated with 20000 wppm of elemental sulfur indicates that there are heterogeneous areas of shot coke and sponge coke produced because the sulfur additive was not uniformly dispersed into the vacuum residuum.

The invention claimed is:

1. A delayed coking process comprising:

a) heating a petroleum resid, which is essentially a solid at room temperature, in a first heating zone, to a temperature below coking temperatures wherein it is converted to a pumpable liquid;

b) conducting said heated resid to a second heating zone wherein it is heated to an effective coking temperature;

c) conducting said heated resid from said second heating zone to a coking zone operating at a temperature between about 410° C. and 475° C. wherein vapor products are collected overhead and coke is formed;

d) introducing into said resid at least one substantially metals-free additive that is effective for the formation of substantially free-flowing shot coke, wherein said substantially metals additive is introduced into said resid at a point upstream of said second heating zone, upstream of said coking zone, or both; and e) removing a substantially free-flowing shot coke from the coking zone where said free-flowing shot coke comprises substantially discrete micro-domains having an average size ranging from about 0.5 to about 10 μm.

2. The process of claim 1 wherein the substantially metals-free additive is one or more of elemental sulfur, high surface area substantially metals-free solids, peroxides and salts of inorganic oxides, such as fumed silica, and mineral acids such as sulfuric acid and nitric acid.

3. The process of claim 2 wherein the substantially metals-free additive is elemental sulfur.

4. The process of claim 2 where the high surface area material is selected from the group consisting of elemental sulfur, high surface area substantially metals-free solids, such as rice hulls, sugars, cellulose, ground coals, and ground auto tires.

5. The process of claim 2 where the substantially metals-free additive is selected from the group consisting of sulfuric acid, sulfuric and/or nitric acid anhydrides, and mixtures thereof.

6. The process of claim 1 further comprising adding caustic to the resid feed.

7. The process of claim 1 further comprising conducting at least one volatile product away from the coking zone.

8. A delayed coking process comprising:

a) contacting a vacuum resid with an effective amount of at least one metals-free additive at a temperature from about 70° C. to about 270° C. for a time sufficient to disperse the additive substantially uniformly into the feed, which additive is one that favors the formation of shot coke;

b) heating the treated resid to a temperature effective for coking said feed;

c) charging said heated and treated resid to a coking zone at a pressure from about 15 to 80 psig at a temperature between about 410° C. and 475° C. for a time sufficient to form a hot coke bed;

d) quenching at least a portion of the hot coke bed with water; and e) removing a substantially free-flowing shot coke from the coking zone where said free-flowing shot coke comprises substantially discrete micro-domains having an average size ranging from about 0.5 to about 10 μm.

9. The process of claim 8 wherein the temperature of step a.) ranges from about 100° C. to about 325° C.

10. The process of claim 8 wherein the metals-free additive is added to the vacuum resid prior to the coking zone.

11. The process of claim 8 wherein an aqueous caustic is added to the resid prior to said coking zone.

12. The process of claim 8 wherein the coking zone is in a coker drum.

13. The process of claim 8 further comprising collecting volatile components overhead in the coking zone.

14. The process of claim 8 wherein the metals-free additive is one or more of elemental sulfur, high surface area substantially metals-free solids, peroxides and salts of inorganic oxides, such as fumed silica and mineral acids such as sulfuric acid, and nitric acid.

* * * * *